US006092831A

United States Patent [19]

Bauvois

[11] Patent Number: 6,092,831

[45] Date of Patent: Jul. 25, 2000

[54] JAW WHICH RELEASABLY HOLDS A SKI BOOT ON A SKI

[75] Inventor: Jean Bauvois, Villard de Lans, France

[73] Assignee: Skis Rossignol SA, Voiron, France

[21] Appl. No.: 09/187,606

[22] Filed: Nov. 6, 1998

[30] Foreign Application Priority Data

Nov. 7, 1997 [FR] France ..... 97 14202

[51] Int. Cl.[7] ..... A63C 9/00

[52] U.S. Cl. ..... 280/625

[58] Field of Search ..... 280/625, 623, 280/626

[56] References Cited

U.S. PATENT DOCUMENTS

| | | | |
|---|---|---|---|
| 4,337,965 | 7/1982 | Salomon | 280/628 |
| 4,902,031 | 2/1990 | Bogner | 280/625 |
| 4,989,893 | 2/1991 | Kowatsch et al. | 280/625 |
| 5,205,575 | 4/1993 | Wladar | 280/625 |
| 5,558,356 | 9/1996 | Challande et al. | 280/625 |
| 5,687,982 | 11/1997 | Challande et al. | 280/607 |
| 5,695,211 | 12/1997 | Challande et al. | 280/625 |
| 5,702,119 | 12/1997 | Challande et al. | 280/625 |
| 5,785,343 | 7/1998 | Challande et al. | 280/634 |

FOREIGN PATENT DOCUMENTS

| | | |
|---|---|---|
| 0 311 832 | 4/1989 | European Pat. Off. . |
| 0 785 003 | 7/1997 | European Pat. Off. . |
| 1503847 | 12/1967 | France . |
| 1503848 | 12/1967 | France . |
| 2334382 | 4/1981 | France . |
| 2722372 | 1/1996 | France . |
| 2722373 | 1/1996 | France . |
| 2722374 | 1/1996 | France . |
| 2743727 | 7/1997 | France . |
| 2743728 | 7/1997 | France . |
| 1 578 893 | 7/1970 | Germany . |
| 1578893 | 7/1970 | Germany . |

*Primary Examiner*—Eric Culbreth
*Assistant Examiner*—Tony Winner
*Attorney, Agent, or Firm*—Fay, Sharpe, Fagan, Minnich & McKee, LLP

[57] ABSTRACT

A binding (1) retains a ski boot (5) on a ski (3) in a releasable manner. A jaw (4, 4*a*, 4*b*) is disposed symmetrically with respect to a longitudinal-vertical plane of symmetry (P). The jaw (4, 4*a*, 4*b*) is resiliently biases against a housing by a compression spring (12) acting on a pulling member (9) which is pivotally attached to the jaw by a pin (10). The jaw (4) includes rollers (14*a*, 14*b*, 15*a*, 15*b*) which help to retain the toe of the ski boot (5) on the ski (3). Two pivot axes (XX', YY') are defined by projections (7*a*, 7*b*) that are received in grooves (8*a*, 8*b*). The projections (7*a*, 7*b*) are defined by the housing (2) and the grooves (8*a*, 8*b*) are on a mating surface of the jaw (4, 4*a*, 4*b*), or vice versa. The pivot axes (XX', YY') are not symmetric with respect to the plane of symmetry (P). One of the axes is displaced a further distance (d) from the symmetry plane (P) than the other such that they operate on the compression springs with different effective lever arms (D1, D2). In this manner, more force is required to pivot the jaw about one of the pivot axes than the other.

12 Claims, 6 Drawing Sheets

JAW WHICH RELEASABLY HOLDS A SKI BOOT ON A SKI

BACKGROUND OF THE INVENTION

The present invention relates to the art of ski bindings and bindings for other snow sports boots and more particularly, to an improvement for a jaw which holds a ski boot in a releasable manner onto a ski.

Generally, a skier's leg and ski boot are held in a releasable manner to a ski by a toe clip or piece at the front end and by a heel clamp particularly a jaw affixed to a ski at the heel end of the ski boot.

In cases of danger to a skier or a skier's leg, the ski boot is released from the ski usually at the heel of the ski boot, or the toe of the ski boot, or by both at the same time. To accomplish this, the toe of the ski boot is usually secured by a jaw, which pivots at least laterally, while the heel of the ski boot is also secured to a jaw, which pivots around a transverse axis. Both the toe and heel of the ski boot are released from the jaws through a release spring whose compression is adjustable to regulate the effort or force that the skier must exert to release himself from the jaws holding the ski boot to the ski.

Traditionally, there are various types of bindings or jaws which allow the ski boot of the skier to be attached to a ski while the skier is practicing skiing, but allow the ski boot to be easily released from the ski in case of a dangerous situation, thus avoiding any injury to the skier's leg. These bindings commonly have a pivoting jaw affixed in the center of the ski and hold and release the ski boot based on a resilient biasing system such as a spring.

In the past, the ski manufacturers have tried to develop and manufacture bindings that release the ski boot which are as structurally symmetric as possible. The geometry, materials, and energization systems were all predicated on this quest for symmetry. Thus, the bindings were symmetrical with respect to the vertical and longitudinal planes of symmetry of a ski. The toe of the ski boot was also symmetrical in geometry and materials.

By way of example, such bindings are described in detail in published French Patent No. 2,334,382. This patent discusses that the leg of the skier around the knee can withstand higher torsion forces directed outward than torsion forces directed inward toward the other ski. Further, bindings have been disclosed with asymmetric lateral detaching mechanisms. These features are also disclosed in French Patent Nos. 1,503,847; 1,503,848; 1,503,849; 2,334,382; 2,722,372; 2,722,373; 2,722,374; 2,743,727; and 2,743,728. The disadvantage of these previous devices is that they have a highly complex construction, which means that they are hard to manufacture and, therefore, have a high manufacturing cost. This results in poor reliability and premature aging of the product.

The present invention contemplates a new and improved apparatus which overcomes the above-referenced problems with asymmetric bindings. It provides a new binding which is simple and reliable.

SUMMARY OF THE INVENTION

The binding of the present invention allows easy release of a leg and ski boot from a jaw which is attached to the ski through two lateral supports that are on opposite sides of a plane of symmetry. The jaw can swing or pivot laterally on either one of the two supports against the action of a resilient biasing system, such as a spring. One of the two pivot axes is farther away from a longitudinal plane of symmetry than the other.

In accordance with the present invention, the releasable binding includes a movable jaw that rocks or pivots against a resilient biasing system, the longitudinal axis of which lies in a longitudinal-vertical plane. The jaw is pivotally supported by two pivot axes. Each of the pivot axes is disposed on an opposite side of the longitudinal-vertical plane to permit the jaw to pivot from a central position. The jaw can pivot outward about one pivot axis or inward about the other pivot axis toward the other foot or ski. The orthogonal projection of one of the pivot axes onto a transverse-vertical plane, which is orthogonal to the longitudinal-vertical plane, has a different symmetry relative to the longitudinal-vertical plane from the projections of the other pivot axis.

As used herein, outward or exterior pivoting motion connotes moving the toe away from the other toe and inward or interior pivoting motion connotes rotating toward the other foot.

In accordance with a more limited aspect of the invention, the two pivot axes for the pivot motion are parallel to each other and parallel to and non-symmetrically on opposite sides of the longitudinal-vertical plane.

In one embodiment, the pivot axes of the pivoting motion are along inclined planes such that arms pivot along paths that extend at a non-right angle to the longitudinal-vertical plane.

In accordance with a more limited aspect of the invention, the first axis releases toward the exterior, but could release otherwise such as, for example, toward the interior.

In accordance with a complementary characteristic, the resilient biasing system holds the jaw against the support piece and more particularly against the two pivot axes. The resilient biasing system has a compression spring that extends between a member connected to the jaw and a rear face of the support member pulling the jaw against the pivot axes.

In another embodiment, the jaw is made from two half jaws which form two separate pieces or arms, which are pivotally linked by a center axle disposed in the longitudinal-vertical plane. The resilient biasing system pulls on the center axle. According to another embodiment, the jaw is of one piece.

In accordance with a more limited aspect of the invention, the pivot axes are formed by projections which are received by grooves. The projections are on the rear part of the support piece and fit into corresponding grooves in the jaw piece. In other embodiments, the grooves are on the rear part of the support piece, and the projections extend from the jaw.

In accordance with another complementary characteristic, the support piece extends outward from the ski and has an axial bore which receives the compression spring and the stop member.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
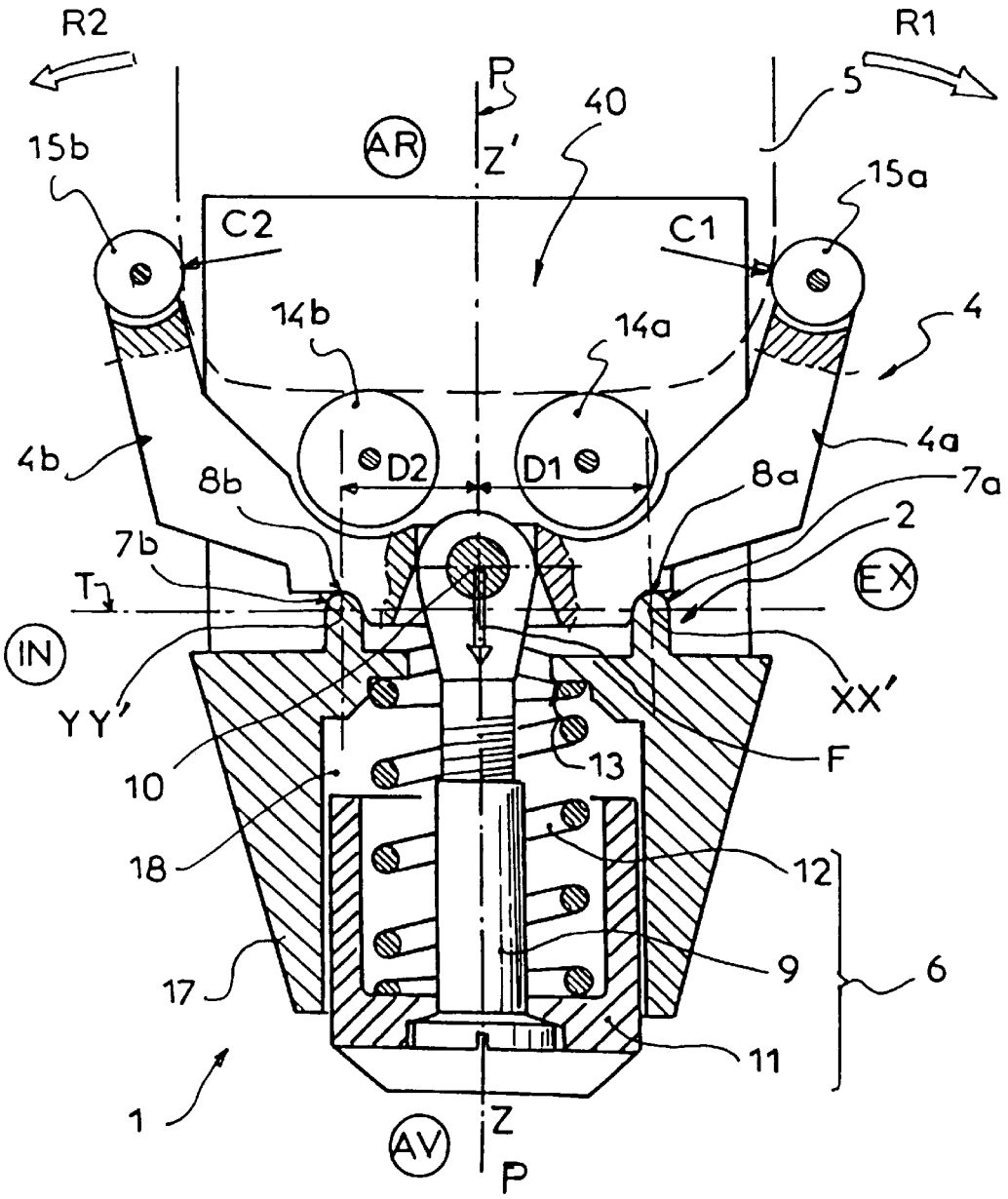
FIG. 1 illustrates a cross-sectional view according to the line AA of FIG. 2.

With reference to FIG. 1, a binding or restraint 1 which lies along a longitudinal-vertical plane of general symmetry P includes a housing or support 2 fixed to the ski 3 and a restraining means or jaw 4 for engaging the ski boot 5. The restraining means 4 is connected with the support piece 2 by a resilient biasing system 6.

The restraining means 4 forms a jaw which holds the toe of the ski boot 5 in a pivotable manner on the support device 2. It allows pivoting around two axes: a first axis XX' and a second axis YY'. These axes are disposed on opposite sides of the longitudinal-vertical plane P. The jaw pivots around these axes in the clock-wise direction shown by arrow R1 from its centered position towards the exterior EX by pivoting around the first axis XX'; and conversely, it pivots in a counter-clockwise direction as shown by arrow R2 towards the interior IN around the second axis YY'.

Figure 2:
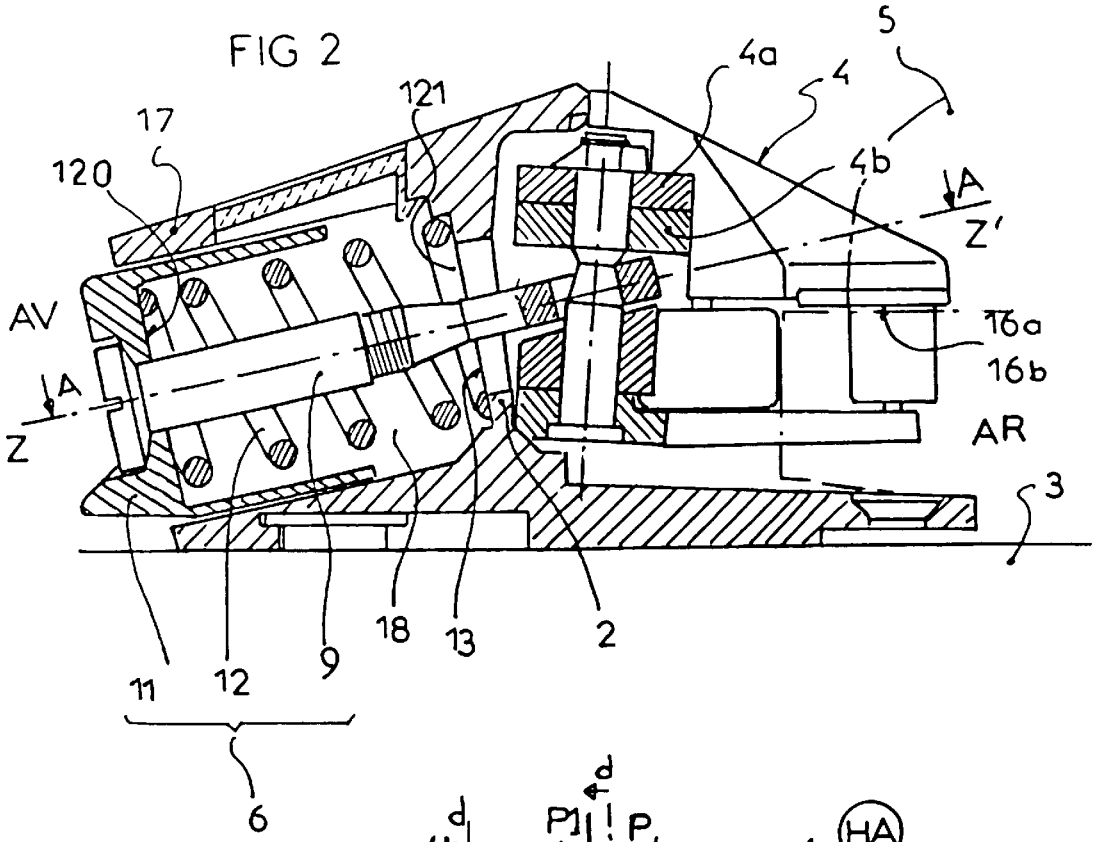
FIG. 2 illustrates a longitudinal cross-sectional view.

The resilient biasing system 6 holds the jaw against the support piece 2 and allows the pivoting around axes XX' and YY'. A pulling member 9 is joined to the jaw 4 at one end, preferably through a pin 10, which is attached at its other end to a support or stop 11. A compression spring 12 is compressed between an inner face or surface 120 (as best seen in FIG. 2) of the stop and an inner rear surface 121 (as best seen in FIG. 2) of the housing 2. Specifically, a frontal surface of spring 13 engages the inner rear surface 121. The longitudinal-vertical plane P of symmetry is symmetric to an axis ZZ' of the binding or restraint 1. The resilient biasing system 6 and the pulling member 9 supporting the spring 12 are also symmetric to the longitudinal-vertical plane P. Therefore, the longitudinal-vertical plane of general symmetry P contains the axis of the member 9 along it. However, as illustrated below, the axis of the pulling member 9 can be offset from the plane of symmetry P.

With continuing reference to FIG. 1, and further reference to FIGS. 2–5, a first embodiment of the invention is shown in more detail where the jaw 4 is constituted by two separate pieces or arms which constitute half jaws 4*a*, 4*b*. The arms are laterally restrained and attached around the center of the restraining means along the symmetry plane P running through the axis formed by the pin 10, around which the pulling member 9 is pivotally or rockably attached. An interior part 40 of the jaw 4 receives the ski boot 5 and includes restraining rollers 14*a*, 14*b*, 15*a*, 15*b*, where 14*a*, 14*b* are the front or toe retaining rollers and 15*a*, 15*b* are the lateral side restraining rollers. Further, the ski boot is held along an upper horizontal edge of the sole by retainers 16*a*, 16*b*.

The pivot axes XX' and YY' are defined by projections 7*a*, 7*b* which extend upward in a generally vertical direction from support piece 2. The projections 7*a*, 7*b* are inserted into corresponding grooves 8*a*, 8*b* which are formed in a rear part of the jaw 4. The support piece 2 also includes body 17 which extends towards the front AV. Further, the body 17 is cylindrical and defines an axial bore 18 which receives the pulling member 9, the spring 12, and the stop 11.

One of the pivot axes is offset a distance d further from the plane of symmetry than the other axis. The offset or displacement is laterally with respect to the symmetry plane P such that a distance D1 between the first axis XX' and the plane P is different from a distance D2 between the second axis YY' and the same plane P. Preferably, the binding or restraint 1 positions the first axis XX', which is displaced further from the symmetry plane than the axis YY', adjacent the exterior EX of the ski. This permits the jaw to pivot around the first axis XX' in response to a torsion force on the leg in the exterior EX direction.

Figure 8:
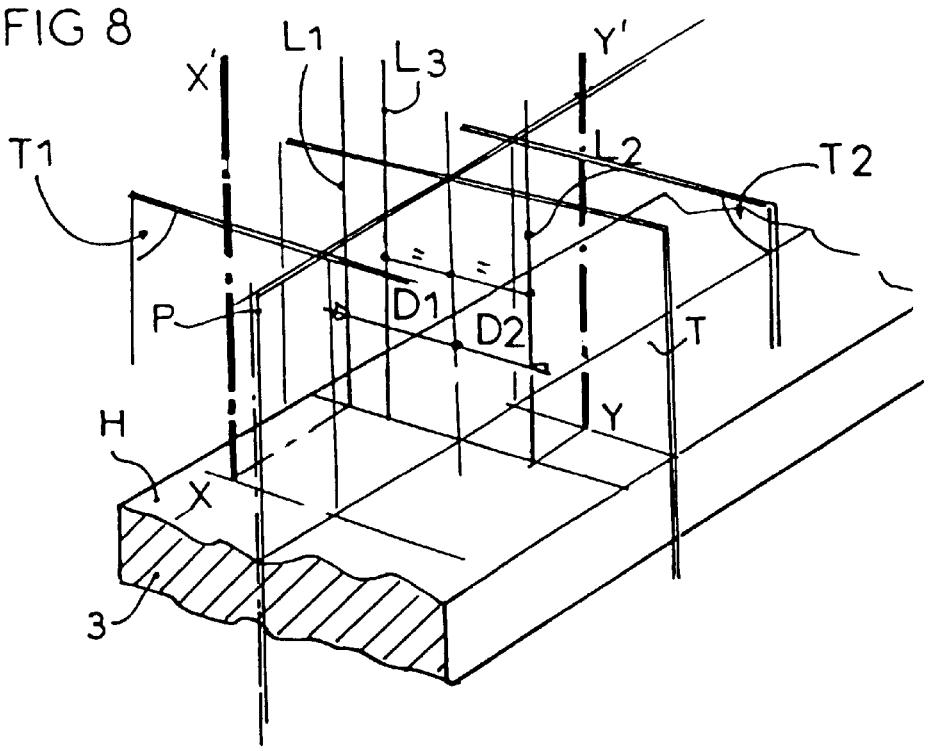
FIG. 8 illustrates the orientation of the pivot axes of another embodiment.

Turning now to FIG. 8, and with continuing reference to FIGS. 1–5, the two pivot axes XX' and YY' extend in a vertical direction and are parallel to each other as well as parallel to the longitudinal-vertical symmetry plane P.

Figure 6:
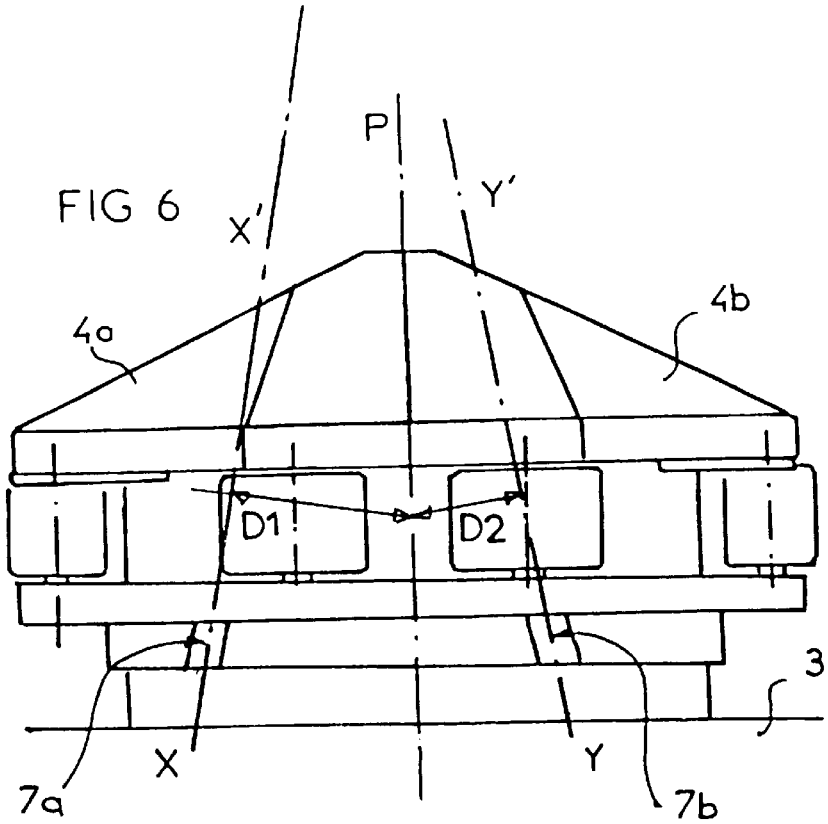
FIG. 6 shows an end view of another embodiment.
Figure 7:
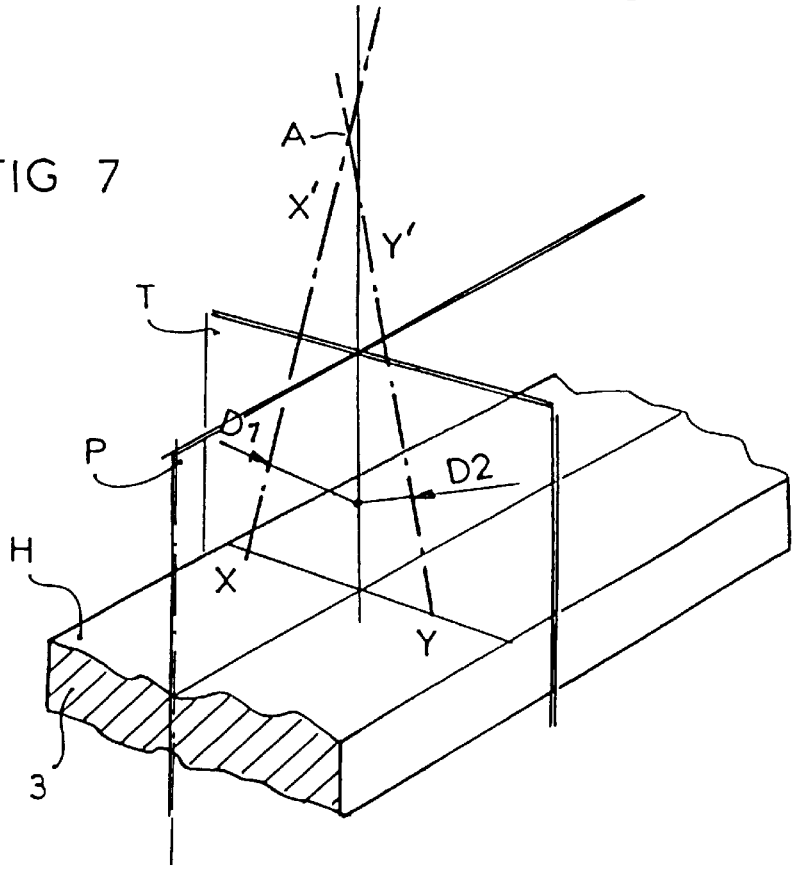
FIG. 7 illustrates the orientation of the pivot axes of another embodiment.

It is to be appreciated that the invention may also incorporate pivoting axes which may not be vertical and parallel. As can be seen in FIGS. 6–7, these axes may converge towards each other. According to this embodiment, the two support pivot axes XX' and YY' extend up in an inclined manner towards the longitudinal-vertical plane P and converge to a point A. With respect to the parallel axes in the first embodiment, the axes in this embodiment allow the person to move laterally towards the exterior EX of the ski, and away from the longitudinal-vertical plane P, through lateral movement around the first axis XX'.

Figure 3:
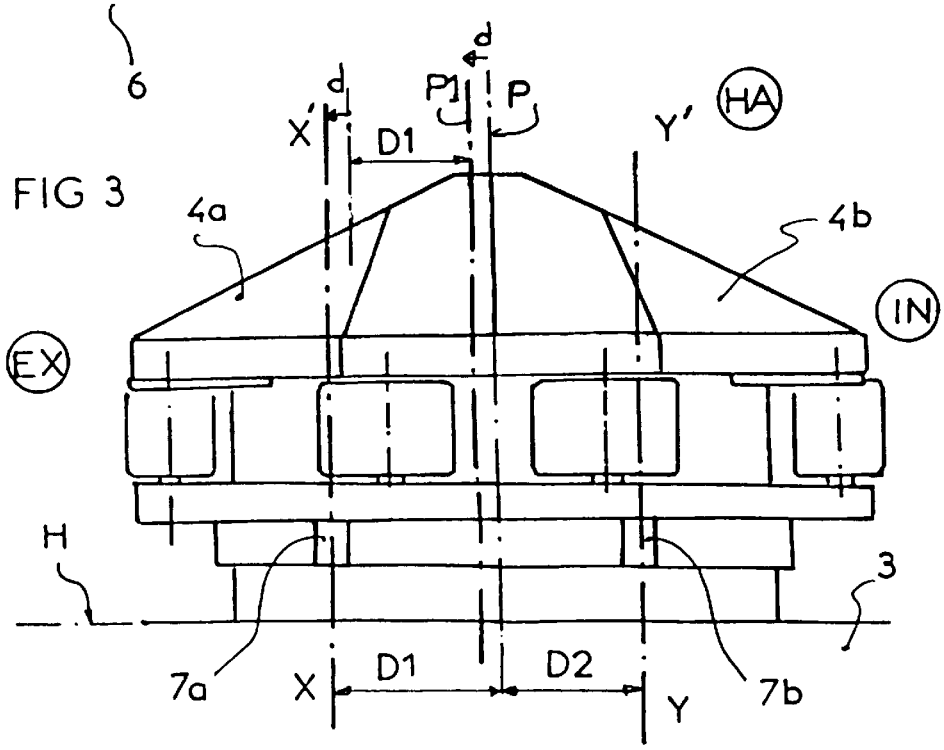
FIG. 3 illustrates an end view.
Figure 4:
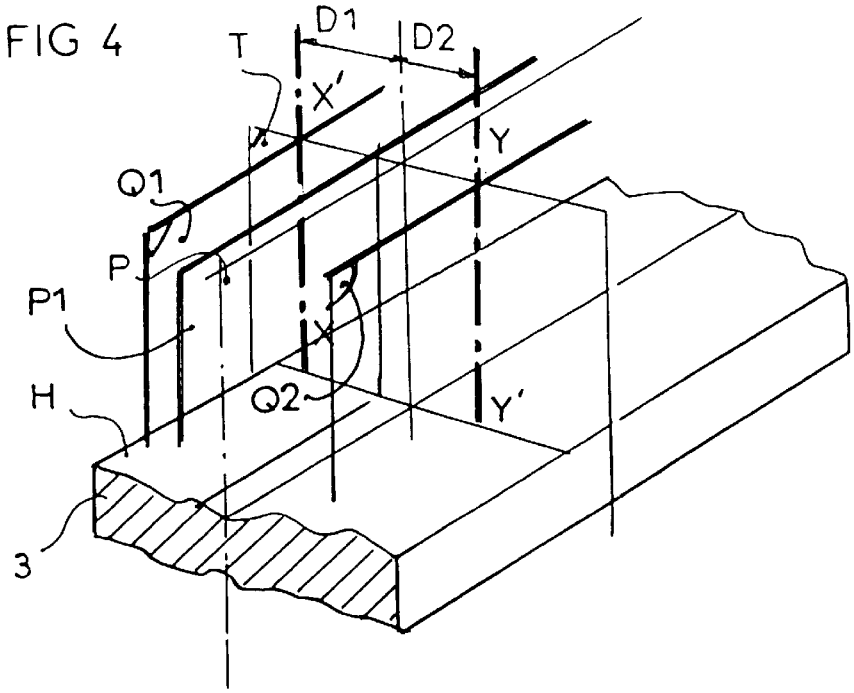
FIG. 4 is a simplified diagram illustrating the planes and projections associated with the pivot axes.
Figure 5:
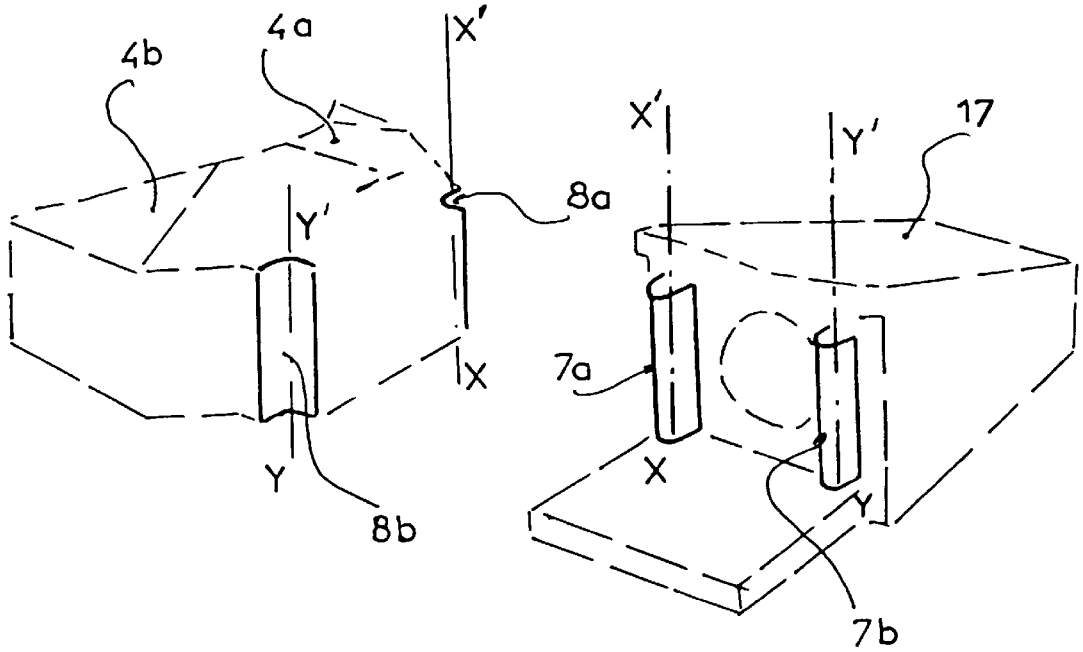
FIG. 5 is a perspective view illustrating the mating of the jaw and the binding body.

It is to be appreciated that in the above-described embodiments, as seen in FIGS. 3–4, the two pivot axes XX' and YY' have a longitudinal plane of symmetry P1 which is different than the longitudinal plane of general symmetry P running through the center of the holding or pulling member 9. Therefore, the plane of symmetry P1 of the two pivoting axes XX' and YY' is parallel to the longitudinal-vertical plane P and allows a lateral movement towards the exterior EX of the ski.

Figure 9:
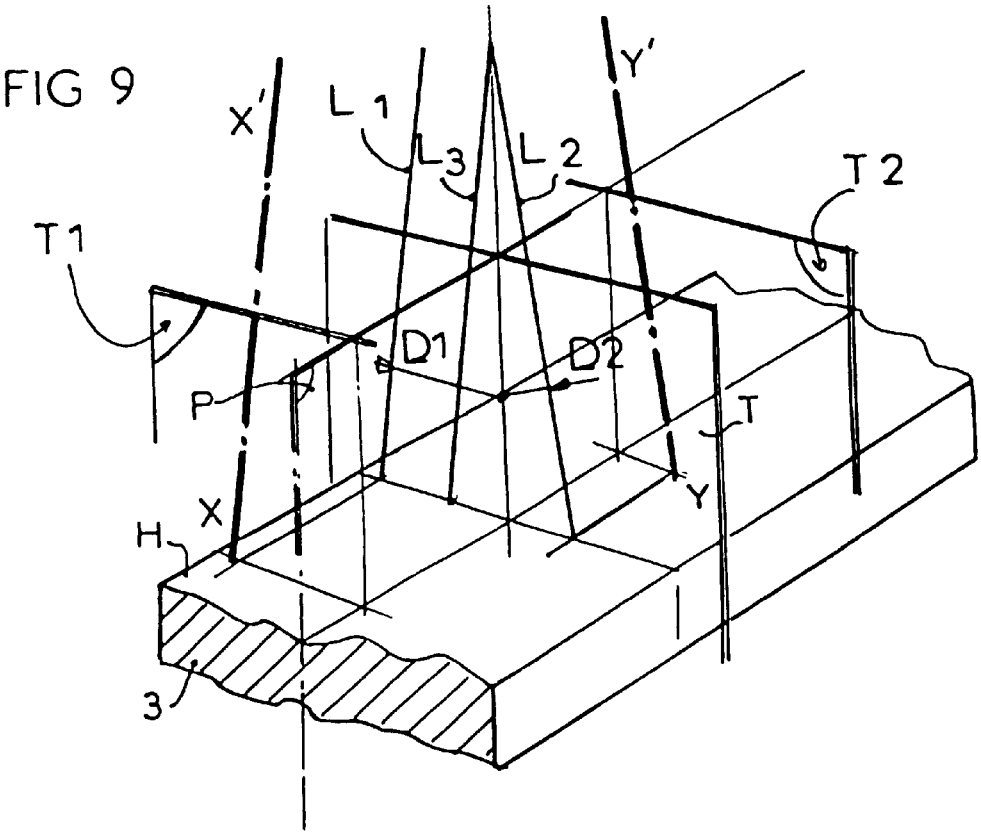
FIG. 9 illustrates the orientation of the pivot axes of yet another embodiment.
Figure 10:
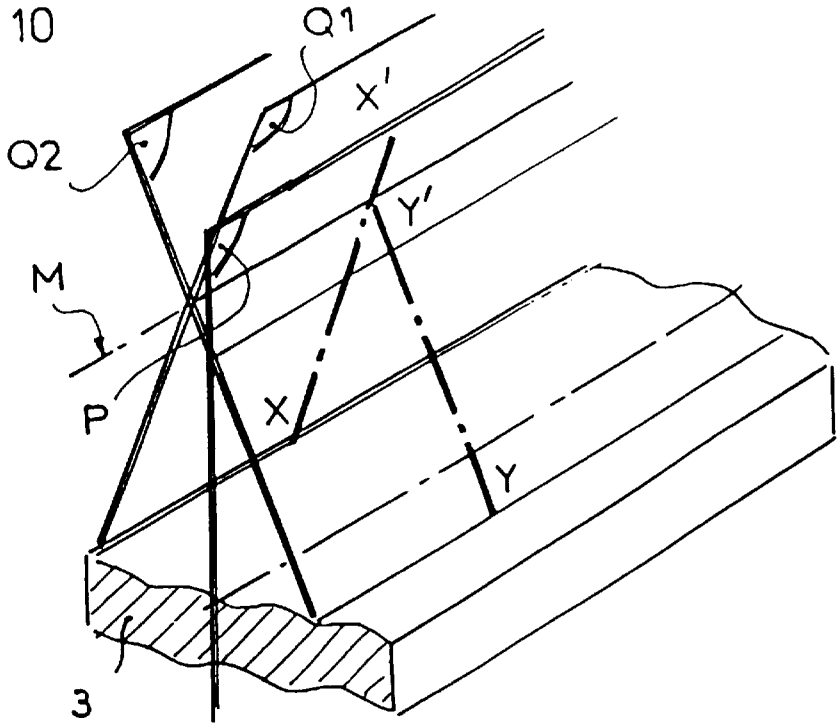
FIG. 10 illustrates the orientation of the pivot axes of still another embodiment; and, FIG. 11 is a top plan view of an alternate embodiment.

It is also to be appreciated, that although the two pivoting axes XX' and YY' are contained in a common transverse-vertical plane T, this could be modified as is known in the art. For example, the two support axes for the pivoting XX' and YY' can be in two different transverse planes, respectively, T1 and T2, as is best seen in FIGS. 8–9. As is shown in FIG. 9, the two support and pivot axes XX' and YY' do not actually converge, but are inclined with respect to each other to be at least converging with respect to the longitudinal-vertical plane P. In this embodiment, two inclined longitudinal planes Q1 and Q2, as best seen in FIG. 10, contain the two pivoting support axes XX' and YY' and converge at axis M which is offset from the longitudinal-vertical plane P.

In the embodiment as shown in FIGS. 1–5, specifically FIG. 4, it is to be appreciated that the two longitudinal planes Q1 and Q2 which contain the pivot support axes XX' and YY' are parallel and non-symmetrical to the longitudinal-vertical plane P.

It is also to be appreciated that a transverse plane which contains either one or both of the axes XX' and YY' and not be perpendicular to a horizontal plane H.

As seen before in FIGS. 8–9, orthogonal projections L2 of the pivot axes YY' onto the transverse plane T, which is orthogonal to the plane of general symmetry P, is symmetrical with respect to a projection L3. Projection L1 of the pivot axis XX' is offset from the projection L3.

It is also to be appreciated that a force C1 on the ski boot, sufficient to pivot the jaw 4 in direction R1 towards the exterior EX of the ski is greater than a force C2 on the ski boot sufficient to pivot the jaw in a direction R2 towards the interior IN of the ski 3.

It is also to be appreciated that the preceding embodiments show the first axis XX', which allows movement to the exterior EX of the ski as being farther from the plane of symmetry than the second axis YY'. However, the present invention could work in a situation where the axis YY', which is taught as allowing movement towards the interior IN of the ski, is farther away, by the distance d (see FIG. 3), from the plane P than the XX' axis.

It is also to be appreciated that the jaw 4 could be made from a single piece and not from two independent arms pieces or half jaws 4*a,* 4*b.*

Figure 11:
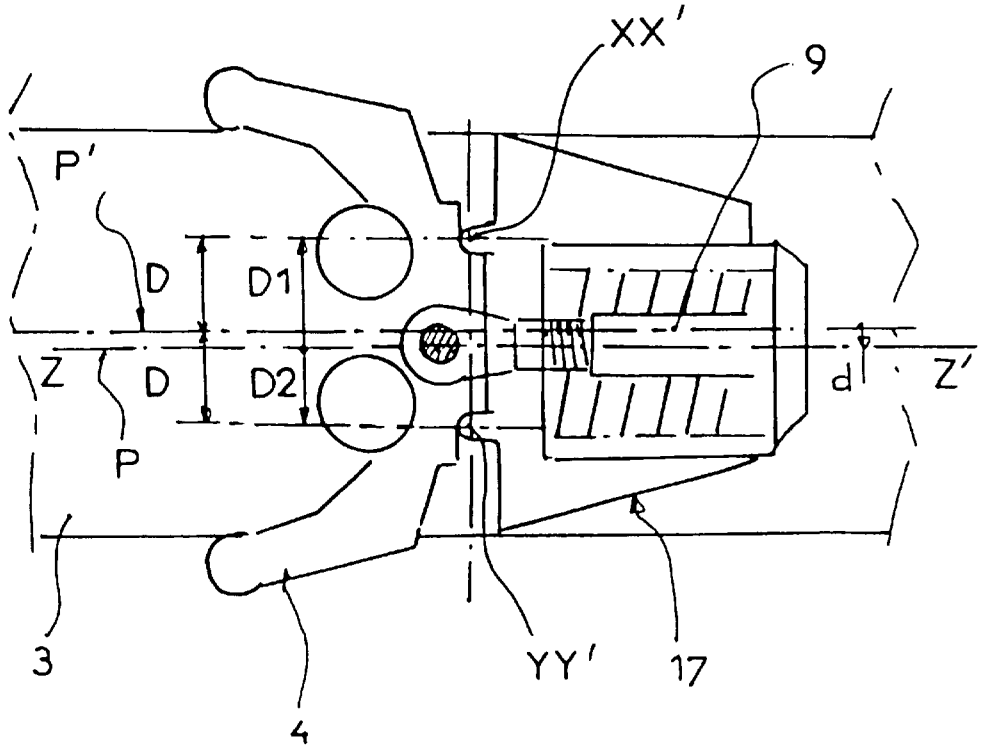

The previously described embodiments, shows the longitudinal-vertical plane P as being the longitudinal-vertical plane of general symmetry of the entire binding or restraint 1 and the ski 3. By contrast, in the FIG. 11 embodiment, the two pivot axes XX' and YY' are equidistant D to the plane P' of general symmetry of the binding or restraint 1 and the ski 3. The vertical longitudinal-vertical plane P running through the pulling member 9 is offset or moved laterally displaced a distance d towards the interior of the ski to create the different lever arms or distances D1, D2.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A device for retaining a ski boot on a ski, the device including:

a jaw for holding the ski boot onto the ski which pivots against a force from a resilient biasing system, the jaw having a longitudinal axis which lies in a longitudinal and vertical plane, the jaw being urged by the resilient biasing system to pivot about a first axis, and a second axis disposed on opposite sides of the longitudinal and vertical plane, such that the jaw pivots laterally from a center position outward towards an exterior area of the ski around the first axis and pivots from the center position inward towards an interior area of the ski around the second axis;

the resilient biasing system including:

a pulling member pivotally coupled at a first end to the jaw and coupled at a second end to a stop;

a housing which defines a longitudinally extending interior bore within which the pulling member is movably received;

a compression spring disposed around the pulling member in the bore of the housing, the spring being compressed between facing surfaces of the stop and the housing;

the first and second axes being disposed relative to the longitudinal and vertical plane such that when the first and second axes are projected onto a transverse plane which is orthogonal to the longitudinal and vertical plane, the projection of the second axis is offset from a third axis, the first and third axes being disposed on the transverse plane symmetrically about the longitudinal and vertical plane.

2. The device according to claim 1, wherein:

the first and second axes are parallel to each other and to the longitudinal and vertical plane such that first and second longitudinal planes which, respectively, contain the first and second axes are parallel and non-symmetric to the longitudinal-transverse plane.

3. The device of claim 1, wherein:

the first and second axes converge such that first and second planes, which, respectively, contain the first and second axes converge towards each other and cross at a line which is parallel to and offset from the longitudinal-vertical plane.

4. The device according to claim 1, wherein:

the first axis is offset toward the exterior area of the ski.

5. The device according to claim 1, wherein:

the second axis is offset towards the interior area of the ski.

6. The device according to claim 1, wherein:

the jaw includes two half-jaws which form two independent lateral arms that are connected by a pin disposed in the longitudinal and vertical plane, the pulling member being connected to the pin.

7. The device according to claim 1, wherein:

the jaw is constructed from a unitary piece.

8. The device according to claim 1, wherein:

the first and second axis are defined by first and second projections which cooperate with first and second grooves, respectively.

9. The device according to claim 8, wherein:

the first and second projections are defined extending from the housing toward the jaw and the first and second grooves are defined in the jaw.

10. The device according to claim 8, wherein:

the first and second projections are defined in and extend from the jaw towards the housing and the first and second grooves are defined in the housing.

11. The device according to claim 1, wherein:

the housing is mounted to the ski extending toward a front of the ski and defines the pulling member receiving bore therein.

12. A ski binding which releases a ski boot from a ski in response to torsional forces, the ski binding comprising:

a U-shaped jaw which receives one end of a ski boot therein;

a pivot pin connected to a central portion of the jaw;

a resilient biasing system for urging the pivot pin to move along a longitudinal axis of the ski;

a body member connected with the resilient biasing system such that the biasing system biases the jaw against the body member with a selected force;

a first pivot axis defined between the body member and the jaw to one side of the pivot pin defining a first lever arm between the pivot pin and the first pivot axis such that torsional force toward the one side causes the jaw to pivot about the first pivot axis acting against the biasing system with the first lever arm;

a second pivot axis defined between the body member and the jaw toward an opposite side of the pivot pin from the first pivot axis defining a second lever arm between the pivot pin and the second pivot axis such that torsional force toward the opposite side causes the jaw to pivot about the second pivot axis acting against the biasing system with the second lever arm;

the first lever arm being longer than the second lever arm such that more torsional force is needed to pivot the jaw toward the one side than toward the opposite side.

* * * * *